US007807327B2

(12) United States Patent
Hayashi et al.

(10) Patent No.: US 7,807,327 B2
(45) Date of Patent: Oct. 5, 2010

(54) METHOD FOR PRODUCING ELECTROPHOTOGRAPHIC TONER

(75) Inventors: Kenji Hayashi, Hachioji (JP); Mikio Koyama, Kunitachi (JP); Hiroyuki Yasukawa, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1298 days.

(21) Appl. No.: 11/333,439

(22) Filed: Jan. 17, 2006

(65) Prior Publication Data

US 2006/0166119 A1 Jul. 27, 2006

(30) Foreign Application Priority Data

Jan. 21, 2005 (JP) ..... 2005-013889

(51) Int. Cl.
*G03G 9/087* (2006.01)

(52) U.S. Cl. ..... 430/137.14; 430/137.17

(58) Field of Classification Search ..... 430/137.14, 430/137.15, 137.17, 137.19
See application file for complete search history.

(56) References Cited

U.S. PATENT DOCUMENTS 4,711,620 A * 12/1987 Takahashi et al. ..... 418/96
5,367,039 A * 11/1994 Yabuuchi et al. ..... 526/284
6,313,066 B1 * 11/2001 Takayama ..... 503/201
6,821,695 B2 11/2004 Matsushima et al.
2006/0029876 A1 * 2/2006 Nomiya et al. ..... 430/110.2

FOREIGN PATENT DOCUMENTS

| | | |
|---|---|---|
| GB | 1563240 | 3/1980 |
| GB | 2109572 | 6/1983 |
| JP | 08022149 | 1/1996 |
| JP | 08272133 | 10/1996 |
| JP | 09269685 | 10/1997 |
| JP | 10207115 | 8/1998 |
| JP | 10312082 | 11/1998 |
| JP | 11-305478 | * 11/1999 |
| JP | 2003066646 | 3/2003 |

OTHER PUBLICATIONS

Grant, R., et al, Grant & Hachk's Chemical Dictionary, Fifth edition, McGraw-Hill Book Company, NY (1987), p. 621.*
Japanese Patent Office machine-assisted translation of JP 11-305478 (pub. Nov. 1999).*
Nippon Oil Corp. Product Information Sheet for "Nisseki Polybutene (Polybutene)," copyright 1999-2009.*

* cited by examiner

*Primary Examiner*—Janis L Dote
(74) *Attorney, Agent, or Firm*—Lucas & Mercanti, LLP

(57) ABSTRACT

A method for producing an electrophotographic toner comprising the step of polymerizing two or more polymerizable monomers under existence of a non-polar liquid hydrocarbon, wherein at least one of the polymerizable monomers comprises a polar group; a kinematic viscosity of the liquid hydrocarbon at 40° C. is in the range of 7-300 $mm^2/s$.

12 Claims, No Drawings

METHOD FOR PRODUCING ELECTROPHOTOGRAPHIC TONER

FIELD OF THE INVENTION

The present invention relates to a method for producing an electrophotographic toner.

BACKGROUND OF THE INVENTION

Together with the increase in the use of small size printers in these days, an oil-less fixing process of a toner image has become the mainstream of the fixing method, in which the electrophotographic toner image is fixed without coating oil. Also, use of a considerable amount of crystalline organic compound in the toner as a release agent has recognized to be effective to lower the fixing temperature of the toner image, however, on the other hand, much use of the release agent also disturbs the development of a low temperature fixing toner because of the heat absorption due to the melting heat of the release agent. Alternatively, a technology to add a liquid lubricant to the toner (for example, refer to Patent Documents 1-3), has been proposed, however, when a low viscosity liquid lubricant is kneaded with a resin, viscosity difference tends to be too large and a problem of a poor dispersion may arise. Further, when the toner pulverizes, the pulverization occurs at the interface of the toner particle, where liquid lubricant exists, accordingly, the liquid lubricant is always existing on the surface of the toner or the liquid lubricant is flowing out of the toner surface, resulting in lowering of the fluidity of the toner particles due to the viscosity of the liquid lubricant. As the result, toner supply system may become unstable, and also image defects may become notable. Further, the toner particles may mutually granulate due to the viscosity of the lubricant to form larger granules. Accordingly, such toner has been stored or transported under a strict temperature control, for example, by use of a coolant, because of the poor storage stability.

Patent Document 1: Japanese Patent Publication Open to Public Inspection (hereafter referred to as JP-A) No. 8-22149

Patent Document 2: JP-A No. 8-272133

Patent Document 3: JP-A No. 9-269685

SUMMARY OF THE INVENTION

An object of the present invention is to provide a producing method of an electrophotographic toner of which the fluidity can be maintained not to become lower, the toner supply system is stable, and a high quality image can be obtained for a long period of time, and further to provide a production method of an electrophotographic toner which can exhibiting an excellent storage stability while attaining a lower fixable temperature and no stickiness of double-sided printing sheets.

One of the aspects of the present invention is a method for producing an electrophotographic toner comprising the step of polymerizing two or more polymerizable monomers under existence of a liquid hydrocarbon, wherein at least one of the polymerizable monomers comprises a polar group; the liquid hydrocarbon is a non-polar compound; a kinematic viscosity of the liquid hydrocarbon at 40° C. is in the range of 7-300 $mm^2/s$.

DESCRIPTION OF THE PREFERRED EMBODIMENTS

In the present invention, it was found that, when an electrophotographic toner is produced by polymerizing two or more polymerizable monomers under existence of a non-polar liquid hydrocarbon (a hydrocarbon which is liquid at 15° C. under 1 atm), wherein at least one of the polymerizable monomers comprise a polar group; and a kinematic viscosity of the liquid hydrocarbon at 40° C. is in the range of 7-300 $mm^2/s$, the liquid hydrocarbon can be contained in the inside of a toner particle without leaking out to a surface of the toner, and effectively can come out to the surface of a toner image only when the toner image is fixed. The mechanism may be explained as follows: under existence of the polymerizable monomers having a polar group, such polymerizable monomers being relatively stably dispersible in an aqueous medium, the non-polar liquid hydrocarbon exists incompatibly with the polymerizable monomer having a polar group, or exists in the inside of the polymerizable monomer particles, accordingly the non-polar liquid hydrocarbon is not exposed on the surface of the toner particles. This is because, the liquid hydrocarbon can exist more stably in the inside of the monomer particles. Accordingly, the liquid hydrocarbon tends not to exist at an interface between the polymerizable monomer particles and the aqueous medium, which will become a toner surface later. As the result, the toner exhibits an excellent fluidity and storage stability while exhibiting the effect of the liquid hydrocarbon when a toner image is fixed.

The above object of the present invention can be attained by at least the following structures.

(1) A method for producing an electrophotographic toner comprising:

polymerizing two or more polymerizable monomers under existence of a non-polar liquid hydrocarbon, wherein at least one of the polymerizable monomers comprises a polar group; and a kinematic viscosity of the liquid hydrocarbon at 40° C. is in the range of 7-300 $mm^2/s$.

It is preferable that the two or more polymerizable monomers comprise a polymerizable monomer having a polar group and a polymerizable monomer having no polar group.

2) A method for producing an electrophotographic toner comprising:

preparing a dispersion liquid comprising a polymerizable monomer having a polar group, a polymerizable monomer having no polar group, a non-polar liquid hydrocarbon, a colorant and water; and polymerizing the polymerizable monomer having a polar group and the polymerizable monomer having no polar group in the dispersion liquid, wherein a kinematic viscosity of the liquid hydrocarbon at 40° C. is in the range of 7-300 $mm^2/s$.

3) A method for producing an electrophotographic toner comprising:

preparing a dispersion liquid comprising a polymerizable monomer having a polar group, a polymerizable monomer having no polar group, a non-polar liquid hydrocarbon and water;

polymerizing the polymerizable monomer having a polar group and the polymerizable monomer having no polar group in the dispersion liquid to form resin particles; and associating the resin particles and colorant particles in an aqueous medium, wherein a kinematic viscosity of the liquid hydrocarbon at 40° C. is in the range of 7-300 $mm^2/s$.

4) An electrophotographic toner produced by polymerizing two or more polymerizable monomers comprising a non-polar liquid hydrocarbon which is contained in the inside of a toner particle (i.e. without leaking out to a surface of the toner particle till fixing), wherein at least one of the polymerizable monomers comprise a polar group; and a kinematic viscosity of the liquid hydrocarbon at 40° C. is in the range of 7-300 $mm^2/s$.

According to the present invention, at least the following effects can be obtained.

1. Even in an oil-less fixing process in which no oil coating member is provided for the fixing member, the lowest fixable temperature can be drastically lowered, and a sufficient fixing strength can be obtained.
2. Since an excellent fluidity of the toner and a stable toner supply system from a toner hopper to a developing unit can be obtained, the variation in the image density is negligible.
3. While attaining a low fixable temperature, an excellent storage stability can be obtained, and no coolant is necessary for transport and storage.
4. Even when an image cooling mechanism is not provided in the case of double-sided printing, no stickiness of double-sided printing sheets can be observed, and the handling property of a large amount of printing sheets is excellent.

In the present invention, specific examples of a polar group of the polymerizable monomer include: a carboxyl group, a hydroxyl group, an amide group, an imide group, a nitro group, an amino group, an ammonium group, a sulfonyl group, a thiol group and a sulfide group. A non-polar liquid hydrocarbon exhibits a Y/X value of 0-0.05, provided that X represents the number of carbon atoms and Y represents the number of hetero-atoms. The non-polar compound is preferably an alkene or an alkane which may have a substituent. The hetero atom for the compound may be oxygen, nitrogen or sulfur.

<Polymerizable Monomer Having a Polar Group>

As a polymerizable monomer having a polar group of the present invention, a radical polymerizable monomer is preferable. Examples of a radical polymerizable monomer having an acidic polar group and a radical polymerizable monomer having a basic polar group include monomers containing: a carboxyl group, a sulfonic acid group; and amine compounds such as a primary amine, a secondary amine, a tertiary amine and a salt of quaternary ammonium.

Examples of a radical polymerizable monomer having an acidic polar group include: monomers having a carboxylic acid group such as acrylic acid, methacrylic acid, fumaric acid, maleic acid, itaconic acid, cinnamic acid, maleic acid mono-butyl ester or maleic acid mono-octyl ester; and monomers having a sulfonic acid group such as styrene-sulfonic acid, allyl sulfosuccinic acid or allyl sulfosuccinic acid octyl. These monomers may be used as a salt of an alkaline metal such as sodium or potassium; or a salt of an alkaline earth metal such as calcium.

Examples of a radical polymerizable monomer having a basic polar group include amines, for example: dimethylaminoethyl acrylate, dimethylaminoethyl methacrylate, diethylaminoethyl acrylate, diethylaminoethyl methacrylate, and quarternary ammonium salts thereof.

As for the polymerizable monomer having a polar group of the present invention, the weight content of a radical polymerizable monomer having an acidic polar group or a radical polymerizable monomer having a basic polar group is preferably 0.1-15% by weight based on the total weight of the monomer.

<Polymerizable Monomer Containing no Polar Group>

Specific examples of a polymerizable monomer containing no polar group include: an aromatic vinyl monomer, an acrylate monomer, a methacrylate monomer and a vinyl ether monomer.

As an aromatic vinyl monomer, for example, a styrene monomer having conjugate $\pi$ electrons and its derivative are listed.

Examples of an acrylate monomer and a methacrylate monomer include: methyl acrylate, ethyl acrylate, butyl acrylate, 2-ethylhexyl acrylate, cyclohexyl acrylate, phenyl acrylate, benzyl acrylate, methyl methacrylate, ethyl methacrylate, butyl methacrylates, hexyl methacrylate, 2-ethylhexyl methacrylate, cyclohexyl methacrylate, benzyl methacrylate and stearyl methacrylate.

<Cross-Linking Agent>

In order to improve the characteristic of a toner, a radical polymerizable cross-linking agent may also be added. Examples of a radical polymerizable cross-linking agent include compounds having two or more unsaturated bonds, for example: divinylbenzene, divinylnaphthalene, divinyl ether, diethylene glycol methacrylate, ethylene glycol dimethacrylate, polyethylene glycol dimethacrylate and diallylphthalate.

It is preferable that the radical polymerizable cross-linking agent, although depending on its characteristic, is used in the range of 0.1-10% by volume based on the total weight of the radical polymerizable monomer.

<Non-Polar Liquid Hydrocarbon>

The liquid hydrocarbon having a kinematic viscosity at 40° C. of 7-300 $mm^2/s$, preferably 12.1-205 $mm^2/s$ of the present invention is preferably an $\alpha$-olefin, and more preferably a poly 1-butene. The weight content of the added liquid hydrocarbon is preferably 0.5-20% by weight based on the total weight of the toner.

The preferable range of the peak molecular weight of the liquid hydrocarbon is 200-3000, and more preferably 250-550, wherein the molecular weight means a styrene conversion molecular weight measured by gel permeation chromatography. In the measurement, tetrahydrofuran is used as the solvent, and three serially connected columns of TSKGELG 2000 (exclusion limit: 10000) produced by Tosoh Corp. are used for the measurement. The $\alpha$-olefin may be subjected to hydrogenation to break the double bond, however, in order to lower the fixing temperature of a toner, it is preferable to leave double bond at a part of the molecule, preferably, at an end of the molecule.

Next, the preferable range of kinematic viscosity at other temperatures of the liquid hydrocarbon of the present invention will be described. At 100° C., preferable is 1.5-20 $mm^2/s$, preferably 2.7 to 14 $mm^2/s$. The measurement of the kinematic viscosity is based on JIS K2283, and carried out by using B-type viscometer (made by TOKIMEC Inc.). The temperature of 40° C. at which kinematic viscosity is measured is selected and set as an upper limit of the storage temperature, and that of 100° C. is selected and set as an lower temperature of the toner fixing temperature.

A preferable volatile component in the liquid hydrocarbon will be described. It is preferable that the amount of liquid hydrocarbon evaporated at 20° C. in 5 hours is 0.01-2.5% by weight of the amount of liquid hydrocarbon evaporated at 90° C. in 30 minutes. In order to minimize a slight odor at the evaporation, and to avoid the increase in lowest fixable temperature due to the latent heat of evaporation, (the fixing ratio is lowered due to the latent heat), the above described evaporation range is preferable.

The amount of evaporation is measured by the Purge & Trap GC/MS. The amount of evaporation is expressed by a converted value using a calibration curve made for hexadecane. The detailed conditions are as follows:

<Volatile Organic Substance Recovery Condition)
Out-gas collection device: HM-04GW
Capacity of a container: 160 ml
Recovery in 90° C. He 100 ml/min 30 min. TENAX TA
An amount of sample: 10 mg (Details of the Purge $ Trap GC/MS Measurement Analysis Condition)
TFER HEATER: 250° C.
NEEDLE HEATER: 250° C.
SAT HEATER: 200° C.
SAT: TENAX TA (F280, L10 mm)
HEAD PRESS.: 117 kPa
COLUMN FLOW: 2.0 ml/min
SPLIT RATE: 1/1000 (GC-2010)
OVEN TEMP.: 40° C. (3 min)—(10° C./min)—280° C. (3 min)
DET. TEMP.: 260° C.
ANA. TIME: 30 min (GCMS-QP2010)
MASS RENG: 40-800
SCAN TIME: 0-30 min
EM=0.75 kV
Column: DB-5MS:-0.25 mm×30 m, t: 0.25 μm
SAT: TENAX TA(F280, L10 mm)
HEAD PRESS: 117 kPa
COLUMN FLOW: 2.0 ml/min.

Among the liquid hydrocarbon products available in the market, examples of liquid poly-butene available in the market include: LV-7, LV-10, LV-25, LV-50 and LV-100 produced by NIPPON PETROCHEMICALS Co., Ltd.; MOBIL SHF21, SHF41, SHF61, SHF82, SHF401 and SHF1003 which are α-olefin produced by Mobil Chemical Products International Inc.; and LUCANT HC-10, HC-20 and HC-40 which are ethylene-α-olefin (40° C. kinematic viscosity: 38 $mm^2/s$) produced by MITSUI CHEMICALS Inc.

In the present invention, liquid poly-butadiene is also usable. As the liquid poly-butadiene available on the market, B-1000, B-2000 and B-3000 produced by NIPPON PETROCHEMICALS Co., Ltd. are listed.

Further, in the present invention, liquid paraffin is also employable. As the liquid paraffin available on the market, specifically preferable is food-grade white oil. Food-grade white oil is preferable because it exhibits high heat resistance, limited odor, and excellent fixing property. Further, food-grade air line oil H-1: grades 22, 32, 46, 68 produced by SCHAEFFER MANUFACTURING COMPANY are employable. Food-grade white oil is a kind of paraffin oil. Among the white oils, specifically preferable is a USP Grade white oil (the manufacturing method and control method determined by US Pharmacopoeia Codex are applied). The white oil is manufactured by using a hydrogenating method. The U.S. Pat. No. 3,459,656 description of Rausch discloses the way of manufacturing the white oil of an industrial grade and a food-grade by the catalytic hydrogenation in two manufacturing processes.

<Other Additives>

In the present invention, together with the liquid hydrocarbon which is non polar and exhibits kinematic viscosity at 40° C. of 7-300 $mm^2/s$, a release agent, and a fixing aid both of which are solid at 40° C., are preferably used.

Specific examples of a release agent include: (i) poly-olefin-waxes, for example, poly-propylene and polyethylene; (ii) paraffin wax, Fisher-Tropsch wax, microcrystalline wax, metallocene, which are trivial names after the manufacturing methods; (iii) fatty acid waxes having 12-24 carbon atoms and ester compounds thereof; and (iv) other waxes, for example, a higher alcohol wax, lanolin wax, carnauba wax, rice wax, bees wax, scale insect wax and montan wax. The DSC endothermic peak temperature corresponding to the melting point of a release agent preferably exists in 55-100° C.

The weight content of the solid release agent is preferably 1-30% by weight, and more preferably 4-24% by weight of toner. The heat of melting estimated from the endothermic peak is preferably 2.0-30 J/mg. However, after it is added to the toner, the heat of melting is preferably in the range of 0.5-18 J/mg due to the lowering of crystallinity.

As a compound which works as a fixing aid, preferable is a crystalline polyester prepared by a condensation polymerization of: (i) an alcohol component containing 80% by mole or more of an aliphatic diol having 2-6 carbon atoms, preferably 4-6 carbon atoms; and (ii) a carboxylic acid component containing 80% by mole or more of a dicarboxylic acid compound having 2-8 carbon atoms, preferably 4-6 carbon atoms, and more preferably 4 carbon atoms.

Examples of a preferable aliphatic diol having 2 6 carbon atoms include: ethylene glycol, 1,2-propylene glycol, 1,3-propylene glycol, 1,4-butane diol, 1,5-pentane diol, 1,6 hexane diol, neopentyl glycol and 1,4-butene diol. Of these, specifically preferable is an α,β-linear alkane diol.

It is preferable that the aliphatic diol having 2-6 carbon atoms is contained in the alcohol component by 80% by mole or more, preferably 85-100% by mole, more preferably, 90-100% by mole, and it is specifically preferable that one kind of aliphatic diol occupies not less than 70% by mole of the alcohol component, more preferably not less than 80% by mole and further more preferably 85-95% by mole.

In the alcohol component, a polyvalent alcohol other than an aliphatic diol, having 2-6 carbon atoms may be contained. Examples of the polyvalent alcohol include: (i) divalent aromatic alcohols such as bisphenol A added with alkylene (with 2-3 carbon atoms) oxide (average addition mol number: 1-10), for example, polyoxypropylene(2.2)-2,2-bis(4-hydroxyphenyl)propane and polyoxyethylene(2.0)-2,2-bis(4-hydroxyphenyl)propane; and (ii) polyalcohols of trivalent or more, for example, glycerin, pentaerythritol and trimethylolpropane.

Examples of the aliphatic dicarboxylic acid compound having 2-8 carbon atoms include: oxalic acid, malonic acid, maleic acid, fumaric acid, citraconic acid, itaconic acid, glutaconic acid, succinic acid and adipic acid, and anhydrides and alkyl (with 1-3 carbon atoms) esters thereof. Of these, fumaric acid is preferable. Herein, the aliphatic dicarboxylic acid compound represents, as described above, an aliphatic dicarboxylic acid, an anhydride and an alkyl (number of carbons: 1-3) ester thereof. Of these, the aliphatic dicarboxylic acid is preferable.

It is preferable that the aliphatic dicarboxylic acid compound having 2-8 carbon atoms is contained in the carboxylic acid component by not less than 80% by mole, more preferably 85-100% by mole, and further more preferably 90-100% by mole. It is specifically preferable that one kind of an aliphatic dicarboxylic acid occupies not less than 60% by mole of the carboxylic acid component, more preferably 80-100% by mole, and further more preferably 90-100% by mole. From the viewpoint of the storage property of the crystalline polyester, the weight content of fumaric acid in the carboxylic acid component is preferably not less than 60% by mole, more preferably 70-100% by mole, and specifically preferably 80-100% by mole.

In the carboxylic acid component, a polyvalent carboxylic acid compound other than an aliphatic dicarboxylic acid compound having 2-8 carbon atoms may be contained. Examples of such polyvalent carboxylic acid compound include: aromatic dicarboxylic acids, for example, phthalic acid, isophthalic acid and terephthalic acid; aliphatic dicarboxylic acids, for example, sebacic acid, azelaic acid, n-dodecylsuccinic acid and n-dodecenylsuccinic acid; alicyclic dicarboxylic acids, for example, cyclohexanedicarboxylic acid; polyvalent carboxylic acids of trivalent or more, for example, trimellitic acid, pyromellitic acid; and anhydrides and alkyl (number of carbons: 1-3) esters thereof.

Alcoholic component and carboxylic acid component can be condensation polymerized by using an esterification catalyst or a polymerization inhibitor if necessary, in an inert gas atmosphere at 120-230° C. Specifically, in order to increase the strength of the resin, the whole monomer may be charged at a time, or in order to decrease the low molecular weight component, a divalent monomer is initially reacted, then, a monomer of trivalent or more is added to further polymerize. Further, in the later half of polymerization, the reaction may be accelerated by de-pressurizing the system.

Herein, the "crystalline polyester" denotes a polyester exhibiting a largest melting peak in the thermal analysis. Further, the peak melting temperature of the polyester is preferably 65-100° C., and more preferably 77-94° C.

<Toner Manufacturing Method>

In a manufacturing method of electrophotographic toner of the present invention, preferable is an emulsion association method in which resin particles are aggregated and fused to form toner particles in an aqueous medium. Namely, the "association" means a manufacturing method in which resin particles are aggregated and fused to form toner particles in an aqueous medium. "Fusion" means that a plurality of resin particles are united to form one of toner particles. It is preferable that aggregation and fusion are carried out in parallel, however, it is also employable that after the aggregation is once completed, a process in which particles are further fused or united, may also be provided. Examples of a method to aggregation the resin particles include: (i) adding a metal salt as an aggregating agent (also called as a salting agent) to salt out resin particles (a salting out method); (ii) lowering the dispersion stability by raising the temperature of a resin dispersed liquid containing a nonionic surfactant; (iii) using an organic solvent; (iv) reacting a reactive prepolymer. The method to form toner particles by aggregation is not limited, however, in view of excellent transfer property onto the offset printing sheet, the salting out method using a metal salt is preferable.

Resin particles may be formed by using any one of emulsion polymerization, mini-emulsion polymerization, and a method in which resin containing solution is emulsified followed by evaporating the solvent, however, preferable are emulsion polymerization, mini-emulsion polymerization and a method in which multi-layer structure is formed by multi-stage polymerization. Resin is polymerized under the existence of liquid hydrocarbon of which kinematic viscosity at 40° C. is 7-300 $mm^2/s$. Specifically, it is preferable that resin is polymerized while the polymerizable monomer of resin and the liquid hydrocarbon of which kinematic viscosity at 40° C. is 7-300 $mm^2/s$ are mixed each other. More preferably, polymerization is carried out in an aqueous medium containing liquid hydrocarbon of which kinematic viscosity at 40° C. is 7-300 $mm^2/s$, and a oil layer in which a release agent is incorporated, and produced resin particles and a colorant is associated in the aqueous medium. When the storing elastic modulus of the resin or the resin particles is $10^{-3}$-$10^{-4}$ Pa, the liquid hydrocarbon, of which kinematic viscosity at 40° C. is 7-300 $mm^2/s$, does not leak out during the manufacturing process, wherein the measuring conditions of the storing elastic modulus are as follows:

measuring temperature: the polymerization temperature or the association temperature;

forced oscillation: 1 Hz; and amplitude stress: 10 Pa.

Accordingly, in order to achieve a fixing temperature of around 100° C., the association temperature is preferably suppressed at 75° C. or less.

The emulsion association method has an advantage in that: the particles with a sharp distribution of diameters are obtained; and the control of shape and diameter of the toner particles are easy. For example, toner particles of a diameter of 5 μm is prepared as follows: while the particle diameter increases such as 3 μm, 4 μm or 5 μm with time, an aggregation stopping agent is added when the particle diameter is increased up to 5 μm, whereby a toner having a particle diameter of 5 μm is obtained. The aggregation stop reaction can be conducted by: (i) adding a metal salt of which valence is smaller than the metal salt used for the aggregation (for example, potassium chloride may be used when aluminum sulfide is used for aggregation); (ii) addition of a surfactant; or (iii) dilution of the liquid with distilled water. After that, as a shape control process, the mixing is continued at the temperature more than the glass transition temperature of the resin, the shape is rounded due to the surface tension of the resin particles, and after a desired shape is obtained, the temperature of the aqueous medium is cooled, and the reaction is stopped. As the other method, while the mixing is continued at the temperature more than the glass transition temperature of the resin, the mixing force, for example, the rotation rate of the stirrer is increased, and more shearing force is applied to the toner particles to accelerate the formation of heteromorphy.

Resin particles containing a vinylpolymer are preferably prepared via mini-emulsion polymerization in an aqueous medium containing a polymerizable monomer emulsion containing a vinyl polymer. A preferable polymerization method contains the following steps: (i) preparing an aqueous medium in which a surfactant is dissolved within the critical micell concentration; (ii) oil-drop dispersing a polymerizable monomer. Solution in which vinylpolymer is dissolved in the above aqueous medium, using a mechanical energy; (iii) adding a water-soluble polymerization initiator to the above dispersed solution, whereby radical polymerization is carried out in each oil-drop (hereinafter, in the present invention, this method is called as "mini emulsion method"). The resin particles obtained by this method more fully exhibits the effect of the present invention. Herein, in the above method, an oil-soluble polymerization initiator may also be used instead of the water soluble polymerization initiator, or together with the water soluble polymerization initiator.

According to the mini emulsion method which mechanically forms an oil drop, different from the normal emulsion polymerization method, the vinylpolymer dissolved in the oil phase is effectively compounded with the polymerizable monomer, and the vinyl polymer is more uniformly distributed. Also, a sufficient amount of vinylpolymer is incorporated in the resin particles.

The dispersion apparatus to conduct the oil-drop dispersion using a mechanical energy is not specifically limited, and, for example, CLEARMIX produced by M-TECHNIQUE Co., Ltd., having a high rate spinning rotor; an ultrasonic dispersion apparatus; a mechanical homogenizer; Manton-gaulin homogenizer; and a high-pressure homogenizer are usable. The diameter of dispersed particles is preferably 10-1000 nm, more preferably 50-100 nm and further more preferably 30-300 nm.

Accordingly, as a preferable method to form a shell by resin particles, listed are, for example: (i) a method to fix resin particles containing no vinyl polymer on the surfaces of core particles by a dry method; and (ii) a method to aggregate resin particles (s), first, until stable core particles are formed, followed by fixing resin particles (t) containing no vinyl polymer on the surfaces of the resin particles (s) by adding a dispersion liquid of resin particles (t) and an aggregation coagulant if necessary. Specifically, it is possible that, after the resin particle (s) is aggregated, the dispersion liquid of the resin particle (t) is added, and fused.

The heat resistant storage stability and fluidity of the toner is increased by forming a shell. Further, since the composition of the toner particle; surface becomes more uniform, the charge distribution on the toner surface also becomes uniform, resulting in improving the image transfer property.

The dispersion liquid of the toner particles prepared in the above described methods is, then, solid-liquid separated by using well-known separation methods such as: centrifugal dehydration and decanter, followed by washing the particles are washed. The temperature of washing is preferably 20-50° C., and more preferably 35-45° C.

The washed toner particles obtained as above is dried by using well known devices, such as: a flash dryer, a fluidized bed dryer, or a modified device thereof, thus, the preparation of a toner particle is completed. The drying temperature is preferably 20-50° C., more preferably 35-45° C.

An external additive is provided on the surfaces of the toner particles by charging an external additive and toner particles in HENSCHEL MIXER (produced by MITSUI MINING Co., Ltd.) and agitated. The mixing temperature is preferably 20-35° C., the mixing duration is preferably 5-30 minutes, and the peripheral speed of the rotating mixing blade is preferably 20-45 m/s.

The electrophotographic toner of the present invention can be used as a mono-component developer, or a two-component developer. When it is used as a mono-component developer, in a non-magnetic mono-component developer or a toner, magnetic particles with a diameter of 0.1-0.5 μm may be contained, and can be used as a magnetic mono-component developer which may be widely used. Alternatively, a mono-component toner may be mixed with carrier particles and can be used as a two-component developer. Examples of magnetic particles as a carrier include conventional materials known in the art, typically magnetic particles containing iron, for example: iron, ferrite and magnetite. The weight median particle diameter of the above magnetic particles is preferably 15-100 μm. Toner particles and carrier particles are preferably mixed, for example, in a V-type mixer or in a double-cone mixer, with a toner content of 3-209 by weight, and a mixing duration of 5-60 minutes.

EXAMPLES

Hereinafter, examples are illustrated and the present invention is described, however, the present invention is not limited thereto.

Example

Manufacture of Toner

Inventive Toner-1

1. Preparation of Resin Particles for Surface Structuring s1

Resin particles dispersed liquid including resin particles s1 to be fixed on the surface of core particles (S1) was prepared.

[Preparation of Resin Particles for Surface Structuring (1-1-1)]

<<Preparation of Polymerizable Monomer Solution 1-1-1>>

The polymerizable monomer solution containing the following compounds was mixed, which was referred to as polymerizable monomer solution 1-1-1.

| | |
|---|---|
| styrene: | 70.1 weight parts |
| n-butyl acrylate: | 19.9 weight parts |
| methacrylic acid: | 10.9 weight parts |

In a 5000 ml separable flask equipped with a stirrer, temperature sensor, cooling pipe, and nitrogen introduction device, as an anionic surfactant, 7.08 weight parts of dodecyl sodium sulfate was dissolved in 3010 weight parts of deionized water, and under a nitrogen gas-flow, the inner temperature was raised to 80° C. while mixing, thus, the surfactant solution was prepared.

To the surfactant solution, added was a polymerization initiator solution in which 9.2 weight parts of polymerization initiator (potassium persulfate; KPS) was dissolved in 2000 weight parts of deionized water, and after the temperature was raised to 75° C., polymerizable monomer solution 1-1-1 was dropped in 1 hour. After the dropping was completed, this system was further agitated over 2 hours at 75° C. to complete the polymerization (the first stage polymerization), thus, resin particles were prepared, which were referred to as resin particles for surface structuring (1-1-1).

These resin particles have a peak molecular weight at 35,000. Further, the volume median diameter of these resin particles was 62 nm, and the containing ratio of the resin particles less than 36 nm in the particle diameter was 0.4-6 in the volume particle diameter distribution.

In the flask equipped with a stirrer, the following composition was mixed. This was referred to as polymerizable monomer solution 1-1-2.

| | |
|---|---|
| Styrene: | 122.9 weight parts |
| n-butyl acrylate: | 49.7 weight parts |
| methacrylic acid: | 16.3 weight parts |
| LV-7 (poly(1-butene), produced by NIPPON PETROCHEMICALS Co., Ltd., kinematic viscosity at 40° C.: 12.1 $mm^2/s$): | 40.0 weight parts |

In a separable flask equipped with a stirrer, temperature sensor, cooling pipe, 5.7 weight parts of anionic surfactant (101) was dissolved in 1340 weight parts of deionized water to prepare a surfactant solution. The anionic surfactant was as follows:

(101): $C_{12}H_{25}(OCH_2CH_2)_2OSO_3Na$

After the above surfactant solution was heated to 75° C., polymerizable monomer solution 1-1-2 was mixed and dispersed for 2 hours, by using CLEARMIX produced by M-TECHNIQUE Co., Ltd., which is a mechanical dispersion device having a circulation path, to prepare a dispersion liquid (an emulsion liquid) containing emulsion particle (oil drop) having a dispersion particle diameter of 646 nm.

Subsequently, to the above dispersion liquid (the emulsion liquid), added were 1460 weight parts of deionized water, an initiator solution in which 6.51 weight parts of a polymerization initiator (potassium persulfate KPS) was dissolved in 254 weight parts of deionized water; and 0.75 weight part of n-octyl-3-mercaptopropionic acid ester. The above mixture was heated at 80° C. and agitated over 3 hours to carry out polymerization (the second stage polymerization), thus, resin particles which contained resin particles for surface structuring (1-1-2) as a raw material, was obtained, which was referred to as resin particles for surface structuring (1-1-2).

To resin particles for surface structuring (1-1-2) obtained as above, an initiator solution in which 8.87 weight parts of polymerization initiator (KPS) was dissolved in 346 weight parts of deionized water, was added, and, at the temperature of 80° C., the following polymerizable monomer solution 1-1-3 was dropped over 1 hour.

| | |
|---|---|
| styrene: | 322.3 weight parts |
| n-butyl acrylate: | 121.9 weight parts |
| methacrylic acid: | 35.5 weight parts |
| n-octyl-3-mercaptopropionic acid ester: | 9.55 weight parts |

After the dropping was completed, polymerization (the third stage polymerization) was carried out while the mixture was heated and agitated for 2 hours, then, the product was cooled to 28° C. to obtain a dispersion liquid of resin particles for surface structuring s1, in which resin particles for surface structuring (1-1-2) was used as a raw material. This resin particles dispersed liquid was referred to as resin particles dispersed liquid for surface structuring (S1).

After this dispersion liquid was sampled, and dried, the glass transition temperature Tg was measured. Specifically, by using a differential scanning calorimeter, temperature was raised to 100° C., and after the temperature was kept for 3 minutes at that temperature, it was cooled to the ambient temperature at a temperature lowering rate of 10° C./min. Then, the temperature was raised again at a raising rate of 10° C./min. The temperature correspond to the point of intersection between the extension line of a base line below the glass transition point and the extension line of the base line above the point of reverse curve; was determined as the glass transition temperature Tg. DSC-7 produced by Perkin Elmer, Inc. was used for the measurement. The glass transition temperature was determined to be 47° C.

Resin particles for surface structuring s1 showed two peak molecular weights at 35,000, and 11,000, and the weight average molecular weight was found to be 32,000.

2. Preparation of Core Particles 2-1) Preparation of Resin Particles used as a Raw Material of the Core Particles Resin particles for core 2-1-1 was prepared via a two stage polymerization.

In a flask equipped with a stirrer, a mixture of the following compounds was heated to 80° C. and mixed, which was referred to as polymerizable monomer solution 2-1-1.

| | |
|---|---|
| styrene: | 186.9 weight parts |
| n-butyl acrylate: | 76.5 weight parts |
| methacrylic acid: | 19.8 weight parts |
| LV-7 (poly(1-butene), produced by NIPPON PETROCHEMICALS Co., Ltd., kinematic viscosity at 40 C.: 12.1 $mm^2/s$): | 40.0 weight parts |

On the one hand, in a separable flask equipped with a stirrer, temperature sensor, cooling pipe, 4.9 weight parts of anionic surfactant (101) was dissolved in 1364 weight parts of deionized water to prepare a surfactant solution.

After the above surfactant solution was heated to 80° C., polymerizable monomer solution 2-1-1 was mixed and dispersed for 2 hours, by using CLEARMIX produced by M-TECHNIQUE Co., Ltd., which is a mechanical dispersion device having a circulation path, to prepare an emulsion liquid (a dispersion liquid) containing emulsion particle (oil drop) having a dispersion particle diameter of 750 nm.

Subsequently, to the above emulsion liquid (the dispersion liquid), added were 1026 weight parts of deionized water, an initiator solution in which 9.8 weight parts of a polymerization initiator (potassium persulfate KPS) was dissolved in 381 weight parts of deionized water; and 2.88 weight parts of n-octylthiol. The above mixture was heated at 80° C. and agitated over 1.5 hours to carry out polymerization (the first stage polymerization), thus, resin particles (a dispersion liquid of a high molecular weight polymer) was obtained, which was referred to as resin particles for core (2-1-2).

To this dispersion liquid, an initiator solution in which 3.51 weight parts of polymerization initiator (KPS) was dissolved in 137 weight parts of deionized water, was added, and, at a temperature of 80° C., the following polymerizable monomer solution 2-1-2 was dropped over 80 minutes.

| | |
|---|---|
| styrene: | 213.8 weight parts |
| n-butyl acrylate: | 69.4 weight parts |
| n-octanethiol: | 4.55 weight parts |

After the dropping was completed, polymerization (the second stage polymerization) was carried out while the mixture was heated and agitated over 2 hours, then, the product was cooled to 28° C. to obtain a dispersion liquid of resin particles for core (2-1-2), in which resin particles for core (2-1-1) was used as a raw material.

(2-2) Aggregation Process of the Core Particles

Aggregation of colorant particles and resin particles for core (core particles) was carried out by using the colorant dispersed liquid shown below, and the above described resin particles dispersed liquid.

(Preparation of Colorant Dispersed Liquid)

59.0 weight parts of anionic surfactant (101) was dissolved in 1600 weight parts of deionized water while stirring, and to this solution, 420.0 weight parts of carbon black (REGAL 330) was gradually added while stirring. A colorant dispersed liquid was prepared via a dispersion process using CLEARMIX produced by M-TECHNIQUE Co., Ltd. The particle diameter of the dispersed colorant was 93 nm.

(Aggregation Process)

237.2 weight parts (weight of solid substance) of the dispersion liquid of resin particles for core (2-1-2), 2064 weight parts of deionized water and 82 weight parts of the above-described colorant dispersed liquid were charged in a four-necked flask equipped with a stirrer, temperature sensor, cooling pipe, and nitrogen introduction device, and stirred. The temperature inside the flask was adjusted to 30° C., and the pH value of the liquid was adjusted to 10 using an aqueous solution of 5 mole/liter sodium hydroxide.

Subsequently, into the above liquid, a solution in which 40.4 weight parts of magnesium chloride 6-hydrate was dissolved in 40.4 weight parts of deionized water was added under agitation at 30° C. over 10 minutes. After the liquid was left for 3 minutes, the temperature was raised to 75° C. over 60 minutes, thus, aggregation of the resin particles for core (2-1-2) and the colorant particles was carried out.

While the agitation and heating were continued, the particle diameter of the core particles m1 was measured by COULTER COUNTER: TA-II produced by Beckman Coulter Inc. and when the volume median diameter was 5.5 μm, a solution in which 5.1 weight parts of sodium chloride was dissolved in 20 weight parts of deionized was added, and the particle growth was suppressed.

For core particles m1, in the same manner as the resin particles for surface structuring s1, the glass transition temperature Tgm was measured.

In the molecular weight measurement using GPC (Gel Permeation Chromatography), the peak molecular weight was determined to be 15,000, and the weight average molecular weight was found to be 22,000.

3. A Process in which High Tg Resin Particles were Fixed to the Core Particles. (Dispersion Liquid of Toner 1)

3-1) Addition Timing of Dispersion Liquid of Resin Particles for Surface Structuring To 12.5 weight parts (weight of solid substance) of resin particles dispersed liquid for surface structuring (S1), 5 mol/L of sodium hydroxide solution was added to adjust pH to 8.

On the one hand, superheated agitation of the dispersion liquid of the resin particles for core prepared by the aggregation described in 2-2 was continued for more than one hour, and when the degree of circularity was increased to 0.953, the above-described resin particles dispersed liquid for surface structuring (S1) was added, and the resin particle for surface structuring s1 was moved on the surface of the core particles m1 and fused.

The final degree of circularity after the resin particle for surface structuring s1 was fused was 0.956. After that, a solution in which 96.3 weight parts of sodium chloride was dissolved in 385 weight parts of deionized water, was added to weaken the power of aggregation, the agitation while heating was further continued for 2 hours, and the fusion of the resin particles s1 to the core particles m1 was completed. Agitation while heating was further continued until the desired degree of sphericity (or degree of circularity) was obtained. After that, it was cooled to 30° C. at a rate of 8° C./min., acid chloride was added to adjust pH to 2, and then, the agitation was stopped. The resulting liquid was referred to as a dispersion liquid of toner particles 1.

4. Solid-Liquid Separation, Drying, External Addition-Mixing Process 4-1) Solid-Liquid Separation, Drying Process The dispersion liquid of the toner particles 1 was charged in a centrifugal de-hydrator, and washed while spraying deionized water of 40° C., and after that, the particles were dried by warm wind of 40° C. to obtain toner particles 1 of the present invention (also referred to as Inventive Toner 1).

4-2) External Addition-Mixing Process

The above-described toner particles 1 was mixed with 0.8 weight part of hydrophobic silica and 1.0 weight part of hydrophobic titan oxide. The peripheral speed of the rotation blade of a HENSCHEL MIXER (produced by MITSUI MINING Co., Ltd.) was set to 30 m/s, and the mixed particles were further mixed for 25 minutes.

Inventive Toner 2

Inventive Toner 2 was prepared in the same manner as Inventive Toner 1 except that 20.0 weight parts of LV-10 (poly(1-butene), produced by NIPPON PETROCHEMICALS Co., Ltd., kinematic viscosity at 40° C.: 19.4 $mm^2/s$) was used instead of 20.0 weight parts of LV-7 (poly(1-butene), produced by NIPPON PETROCHEMICALS Co., Ltd., kinematic viscosity at 40° C.: 12.1 $mm^2/s$).

Inventive Toner 3

Inventive Toner 3 was prepared in the same manner as Inventive Toner 1 except that 20.0 weight parts of LV-25 (poly(1-butene), produced by NIPPON PETROCHEMICALS Co., Ltd., kinematic viscosity at 40° C.: 52.5 $mm^2/s$) was used instead of 20.0 weight parts of LV-7 (poly(1-butene), produced by NIPPON PETROCHEMICALS Co., Ltd., kinematic viscosity at 40° C.: 12.1 $mm^2/s$).

Inventive Toner 4

Inventive Toner 4 was prepared in the same manner as Inventive Toner 1 except that 20.0 weight parts of LV-100 (poly(1-butene), produced by NIPPON PETROCHEMICALS Co., Ltd., kinematic viscosity at 40° C.: 205 $mm^2/s$) was used instead of 20.0 weight parts of LV-7 (poly(1-butene), produced by NIPPON PETROCHEMICALS Co., Ltd., kinematic viscosity at 40° C.: 12.1 $mm^2/s$).

Inventive Toner 5

Inventive Toner 5 was prepared in the same manner as Inventive Toner 1 except that 20.0 weight parts of food-grade oil H-1, grade 22 produced by SCHAEFFER MANUFACTURING COMPANY, kinematic viscosity at 40° C.: 16.8 $mm^2/s$) was used instead of 20.0 weight parts of LV-7 (poly (1-butene), produced by NIPPON PETROCHEMICALS Co., Ltd., kinematic viscosity at 40° C.: 12.1 $mm^2/s$).

Inventive Toner 6

Inventive Toner 6 was prepared in the same manner as Inventive Toner 1 except that a polymerizable monomer solution having the following composition was used instead of polymerizable monomer solution 1-1-2:

| | |
|---|---|
| styrene: | 122.9 weight parts |
| n-butyl acrylate: | 49.7 weight parts |
| methacryl acid: | 16.3 weight parts |
| LV-7 (poly(1-butene), produced by NIPPON PETROCHEMICALS Co., Ltd., kinematic viscosity at 40° C.: 12.1 $mm^2/s$) | 15.0 weight parts |
| HNP-5 (Fischer-Tropsch wax, made by Nippon Seiro, Co., Ltd., melting point: 62° C.) | 5.0 weight parts |

Inventive Toner 7 (An Example in which Associated Seed Polymerization Resin Particles were Used)

(Liquid Hydrocarbon Dispersed Liquid 1)

68.33 weight parts of deionized water, 30 weight parts of LV-7 (poly(1-butene), produced by NIPPON PETROCHEMICALS Co., Ltd., kinematic viscosity at 40° C.: 12.1 $mm^2/s$) and 1.67 weight parts of sodium dodecylbenzene sulfonate were mixed and emulsified by applying high pressure searing at 70° C. to obtain liquid-hydrocarbon dispersed liquid 1.

(Polymer Primary Particles Dispersed Liquid 1)

In a reactor (capacity of 2 $m^3$) equipped with a stirrer (MAXBLEND blade, produced by SUMITOMO HEAVY INDUSTRIES Ltd.), a heating-cooling device, a concentrating device, and a charging device for materials and additives, 44 weight parts of the above-described liquid-hydrocarbon dispersed liquid 1, 404 weight parts of deionized water charged were charged, and the temperature was raised to 75° C. under a nitrogen atmosphere. Further, 1.6 weight parts of 8% by weight of hydrogen peroxide solution and 1.6 weight parts of ascorbic acid solution were added to the mixture.

After that, the mixture of the following monomers and an emulsifier solution was added over 5 hours from the start of polymerization, and, further, an initiator solution was added over 6 hours from the start of polymerization, then kept for 30 minutes.

| [Monomers] | |
|---|---|
| styrene: | 76 weight parts |
| butyl acrylate: | 24 weight parts |
| acrylic acid: | 3 weight parts |
| bromotrichloro methane: | 0.2 weight part |
| 2-mercaptethanol: | 0.004 weight part |
| hexanediol diacrylate: | 0.9 weight part |
| [Emulsifier Solution] | |
| 15% NEOGEN SC ® solution: | 1 weight part |
| deionized water: | 25 weight parts |
| [Initiator Solution] | |
| 8% hydrogen peroxide solution: | 9 weight parts |
| 8% ascorbic acid solution: | 9 weight parts |

After the polymerization reaction was completed, it was cooled, and milky polymer solution was obtained. The weight average molecular weight of THF soluble part of the polymer was 165,000.

The colorant dispersed liquid the same as used for Inventive Toner 1 was used.

| | |
|---|---|
| polymer primary particles dispersed liquid 1: (for initial mixing) | 22 weight parts |
| polymer primary particle dispersed liquid 1: (for additional addition) | 78 weight parts (13 weight parts for each addition, in total 6 times addition) |
| colorant particles dispersed liquid 1: | 3.0 weight parts (as a solid part) |

By using above-described materials, toner was prepared in the following procedure.

Polymer primary particles dispersed liquid 1 (for initial mixing) and colorant particles dispersed liquid 1 were charged in a reactor, and uniformly mixed. While agitating the obtained mixed dispersion liquid, 0.2 weight part (as solid part) of aluminum sulfate solution was dropped. After that, while agitating, the temperature was raised to 45° C. over 30 minutes, and kept for 0.5 hour. Subsequently, the following procedure was repeated 6 times: namely, to the resultant liquid, polymer primary particles dispersed liquid 1 (13 weight parts for each addition) and aluminum sulfate solution (0.04 weight part as solid part) were added in this order followed by holding for 30 minutes at 45° C. Finally, after NEOGEN SC solution (4 weight parts as solid part) was added, the temperature was raised to 75° C., and held for 2 hours. Then, the system was cooled down to an ambient temperature, and the particles were filtered, washed, and dried to obtain Inventive Toner 7.

Comparative Toner 1 (An example of toner which was prepared by kneading and pulverizing a mixture of separately prepared resin and liquid hydrocarbon of which kinematic viscosity at 40° C. was 7-300 $mm^2/s$)

In a flask equipped with an stirrer, the following composition was humidified at 80° C., and dissolved, which was referred to as comparative polymerizable monomer solution 1.

| | |
|---|---|
| styrene: | 64 weight parts |
| n-butyl acrylate: | 24 weight parts |
| methacrylic acid: | 6 weight parts |

After 1026 weight parts of deionized water was added to the above solution, an initiator solution in which 9.8 weight parts of polymerization initiator (potassium persulfate: KPS) was dissolved in 381 weight parts of deionized water, and 2.88 weight parts of n-octanethiol were added, and polymerized (first stage polymerization) by heating at 80° C. and agitating for 1.5 hours to obtain a resin particles dispersed liquid (a dispersion liquid of high molecular weight resin particles).

To the above liquid, a polymerization initiator solution in which 3.51 weight parts of polymerization initiator (KPS) was dissolved in 137 weight parts of deionized water, was added, and the comparative polymerizable monomer solution 1 was dropped over 80 minutes at 80° C. After the polymerization was completed, the resin particles were dried with a spray drier, and comparative resin particles were obtained.

Comparative Toner 1

Comparative Toner 1 was prepared in the same manner as Inventive Toner 1 except that 94 weight parts of the above comparative resin particles and 6 weight parts of LV-7 (poly (1-butene), produced by NIPPON PETROCHEMICALS Co., Ltd., kinematic viscosity at 40° C.: 12.1 $mm^2/s$) were kneaded by using a 2-axis extrusion kneader, and wind classified by using an air-flow pulverizer and a classifier employing the Coanda effect.

Comparative Toner 2

Comparative Toner 2 was prepared in the same manner as Comparative Toner 1 except that LV-15 (poly(1-butene) produced by NIPPON PETROCHEMICALS Co., Ltd., kinematic viscosity at 40° C.: 655 $mm^2/s$) was used instead of LV-7 (poly(1-butene), produced by NIPPON PETROCHEMICALS Co., Ltd., kinematic viscosity at 40° C.: 12.1 $mm^2/s$).

Comparative Toner 3

Comparative Toner 3 was prepared in the same manner as Comparative Toner 1 except that LV-35 (poly(1-butene), produced by NIPPON PETROCHEMICALS Co., Ltd., kinematic viscosity at 40° C.: 2300 $mm^2/s$) was used instead of LV-7 (poly(1-butene), produced by NIPPON PETROCHEMICALS Co., Ltd., kinematic viscosity at 40° C.: 12.1 $mm^2/s$).

Comparative Toner 4

Comparative Toner 4 was prepared in the same manner as Comparative Toner 1 except that normal paraffin grade H (produced by NIPPON PETROCHEMICALS Co., Ltd., kinematic viscosity at 40° C.: 2.2 $mm^2/s$) was used instead of LV-7 (poly(1-butene), produced by NIPPON PETROCHEMICALS Co., Ltd., kinematic viscosity at 40° C.: 12.1 $mm^2/s$).

Outlines of the liquid hydrocarbon exhibiting 40° C. kinematic viscosity of 7-300 $mm^2/s$ used in the Inventive Toners and Comparative Toners of the present invention were shown in Table 1. In Table 1, "Volatile component (%)" represents the percent by weight of the amount of a liquid hydrocarbon evaporated at 20° C. in 5 hours based on the amount of the liquid hydrocarbon evaporated at 90° C. in 30 minutes.

TABLE 1

| | Liquid hydro-carbon | Peak molecular weight | Volatile component (%) | Dynamic viscosity (40° C.) | Dynamic viscosity (100° C.) |
|---|---|---|---|---|---|
| Inventive Toner 1 | LV-7 | 300 | 1.7 | 12.1 | 2.7 |
| Inventive Toner 2 | LV-10 | 330 | 1.6 | 19.4 | 3.6 |
| Inventive Toner 3 | LV-25 | 390 | 1.5 | 52.5 | 6.4 |
| Inventive Toner 4 | LV-100 | 500 | 1.2 | 205 | 14 |
| Inventive Toner 5 | Food grade oil H-1 grade 22 | 2100 | 0.1 | 16.8 | 3.7 |
| Inventive Toner 6 | LV-7 | 300 | 1.7 | 12.1 | 2.7 |
| Inventive Toner 7 | LV-7 | 300 | 1.7 | 12.1 | 2.7 |
| Comparative Toner 1 | LV-7 | 300 | 1.7 | 12.1 | 2.7 |
| Comparative Toner 2 | HV-15 | 630 | 0.4 | 655 | 31 |
| Comparative Toner 3 | HV-35 | 750 | 0.2 | 2300 | 85 |
| Comparative Toner 4 | Normal paraffin grade H | 150 | 20 | 2.2 | No data |

(Process for Developer Preparation)

Each of the following toners was mixed with one of the following carriers to prepare a developer of which toner content was 6% by weight.

(Preparation of a Carrier)

(1) Preparation of Ferrite Core Particles

A mixture of 18 mol % of MnO, 4 mol % of MgO, 78 mol % of $Fe_2O_3$ was pulverized and mixed for 2 hours in a wet type ball mill, followed by drying. The mixture was calcined at 900° C. for 2 hours and further pulverized for 3 hours in a ball mill to obtain a slurry. Subsequently, a dispersant and a binder was added and dried by using a spray drier, then, baked at 1200° C. for 3 hours to obtain ferrite core particles having a resistance of $4.3\times10^8$ Ω·cm.

(2) Preparation of Resin Particles for Surface of Toner

A copolymer of cyclohexyl methacrylate/methyl methacrylate (copolymerization ratio 5/5) was prepared by a emulsion polymerization method carried out in a 0.3% by weight solution of cyclohexyl methacrylate/methyl methacrylate monomers, wherein the solution contained sodium benzenesulfonic acid, of which alkyl group had 12 carbon atoms, as a surfactant. The obtained resin particles exhibited: a volume median diameter of 0.1 μmm, weight average molecular weight (Mw) of 200,000, number average molecular weight (Mn) of 91,000, Mw/Mn=2.2, softening point temperature (Tsp) of 230° C., and glass transition temperature (Tg) of 110° C. The residual monomer in the resin particle was decreased to 510 ppm by azeotroping with water in the emulsion condition.

Subsequently, 100 weight parts of ferrite core particles and 2 weight parts of the above resin particles were charged into a high speed agitation mixer with an agitation blade, and agitation mixed for 30 minutes at 120° C., and by using an action of the mechanical impact force, resin coated career particles exhibiting volume median diameter of 61 μm were obtained.

(Evaluation of Copy)

By using the commercially available electrophotographic copier (produced by KONICA MINOLTA BUSINESS TECHNOLOGIES, Inc., SITOS 7075), a short-run test was carried out under a condition of 30° C., 90% RH. A common glossy printing paper, N PEARL COAT L (available from MITSUBISHI PAPER SALES Co., Ltd.) was cut into 297 mm×420 mm (A3) size to be used. Evaluations were carried out on the following items according to the following criteria.

(Stability of Toner Supply)

A: Up to the print of 1000,000 sheets, no clogging of toner was observed, and stable supply was conducted. Also, no variation of the image density was detected.

B: Toner clogging was observed at the connection part of a toner hopper and the developing device within 10,000-sheet printing, and the image density was lowered.

(Lowest Fixable Temperature)

The temperature (fixing temperature) of a heating roller was changed (raised) in the range of 75-140° C. with intervals of 5° C., and for each of the fixed images, the fixing ratio was measured, and the temperature at which the fixing ratio increased to 90% was defined as the lowest fixable temperature. The method to measure the fixing temperature was as follows: while the printing sheet was coming out of the heat roller of the copier, the temperature of the printing sheet at 100 mm from the heat roller was measured by using a non-contact thermometer.

A: The lowest fixable-temperature was less than 80° C., almost no-curl of the sheet was observed, no difference in glossiness between a white background part where no image was printed and a toner image part was detected, and a natural and clear image was obtained. Grade: excellent.

B: The lowest fixable temperature was not less than 80° C., but less than 90° C., the curl of the sheet was negligible, and the difference in glossiness between a white background part where no image was printed and a toner image part was negligible. Grade: Good.

C: The lowest fixable temperature was not less than 90° C., but less than 100° C., the curl of the printing sheet was not prominent, the difference in glossiness between a white background part where no image was printed and a toner image part was more or less found. Grade: Usable.

D: The lowest fixable temperature was ore than 100° C., notable curl was observed.

(Storage Stability of Toner)

A: After the toner was left for 48 hours at 45° C., no granule was left on a 100 mesh sieve, and no coolant nor refrigerated transport was necessary for storage.

B: After the toner was left for 48 hours at 45° C., not more than 1% by weight of soft granules were left on a 100 mesh sieve, however, the granules melted while printing and no image defect was observed on the printed image.

C: After the toner was left for 48 hours at 45° C., not less than 10% by weight of granules were left on a 100 mesh sieve, image was contaminated by the granule toner spilled from the developing equipment, and also observed were notable image defects due to the white points occurring at the image transferring process.

Double-sided printing at 25% dot density was continuously carried out for 3000 sheets of 210 mm×297 mm (A4) size printing sheets. The printed sheets were stacked in a unit of 500 sheets in a sheet delivery unit, and the stickiness and the sheet alignment of the double-sided printing sheets were evaluated.

A: No stickiness of the double-sided printing sheets was observed, the sheet alignment was excellent, and the obtained pile of the printing sheets could be used in the book binding process as it was.

B: No stickiness of the double-sided printing sheets was observed, the sheet alignment was not excellent, however, the obtained pile of the copy sheets could be used in a book binding process after realigning the printing sheets.

C: Stickiness of the double-sided printing sheets was observed and noise occurred when the sheets were peeled, the sheet alignment was poor, and it took time to realign the pile of the printing sheets.

TABLE 2

| Toner | Stability of toner supply | Lowest fixable temperature | Storage stability of toner | Stickiness of double-sided printing sheets |
|---|---|---|---|---|
| Inventive Toner 1 | A | A | B | A |
| Inventive Toner 2 | A | A | B | A |
| Inventive Toner 3 | A | A | B | A |
| Inventive Toner 4 | A | A | B | B |
| Inventive Toner 5 | A | A | A | A |
| Inventive Toner 6 | A | B | B | B |
| Inventive Toner 7 | A | B | B | B |
| Comparative Toner 1 | B | D | C | C |
| Comparative Toner 2 | B | C | B | C |
| Comparative Toner 3 | B | D | B | C |
| Comparative Toner 4 | B | B | C | B |

From Table 2, it was found that the electrophotographic toners of the present invention were excellent in all evaluation items.

What is claimed is:

1. A method for producing an electrophotographic toner comprising the steps of:

preparing a dispersion liquid comprising a polymerizable monomer having a polar group, a polymerizable monomer having no polar group, a non-polar liquid hydrocarbon and water;

polymerizing at least the polymerizable monomer having a polar group and the polymerizable monomer having no polar group under existence of the non-polar liquid hydrocarbon in the dispersion liquid to form resin particles; and associating the resin particles and colorant particles in the dispersion liquid, wherein a kinematic viscosity of the non-polar liquid hydrocarbon at 40° C. is in the range of 7-300 $mm^2/s$.

2. The method of claim 1, wherein the non-polar liquid hydrocarbon includes a volatile component evaporated at 20° C. in 5 hours in an amount of 0.01 to 2.5 percent by weight of a volatile component of the non-polar liquid hydrocarbon evaporated at 90° C. in 30 minutes.

3. The method of claim 1, wherein the polar group comprises at least one of a carboxyl group, a hydroxyl group, an amide group, an imide group, a nitro group, an amino group, an ammonium group, a sulfonyl group, a thiol group and a sulfide group.

4. The method of claim 1, wherein the non-polar liquid hydrocarbon exhibits a Y/X value in the range of 0 to 0.05, provided that X represents a number of carbon atoms and Y represents a number of hetero-atoms.

5. The method of claim 1, wherein the polymerizable monomer having a polar group is polymerized in an amount of 0.1-15% by weight based on the total weight of the monomer.

6. The method of claim 1, wherein the polymerizable monomer having a polar group includes at least one of monomers containing a carboxyl group, a sulfonic acid group and amine compounds.

7. The method of claim 1, wherein the polymerizable monomer having a polar group includes at least one of acrylic acid, methacrylic acid, fumaric acid, maleic acid, itaconic acid, cinnamic acid, maleic acid mono-butyl ester, maleic acid mono-octyl ester, styrene-sulfonic acid, allyl sulfosuccinic acid, allyl sulfosuccinic acid octyl, and alkaline metal or alkaline earth metal salt thereof; dimethylaminoethyl acrylate, dimethylaminoethyl methacrylate, diethylaminoethyl acrylate, diethylaminoethyl methacrylate, and quarternary ammonium salts thereof.

8. The method of claim 1, wherein the weight content of the added non-polar liquid hydrocarbon is 0.5-20% by weight based on the total weight of the toner.

9. The method of claim 1, wherein the kinematic viscosity of the non-polar liquid hydrocarbon at 100° C. is 1.5-20 $mm^2/s$.

10. The method of claim 1, wherein the non-polar liquid hydrocarbon includes at least one of poly-butene, ethylene-α-olefin, liquid poly-butadiene, and liquid paraffin.

11. The method of claim 1, wherein a releasing agent and a fixing aid, both of which are solid at 40° C., are both added together with the non-polar liquid hydrocarbon at the preparation of the liquid dispersion step.

12. The method of claim 1, wherein the associating is carried out in the dispersion medium of which temperature is 75° C. or less.

* * * * *